US006669601B2

(12) United States Patent
Marciano

(10) Patent No.: US 6,669,601 B2
(45) Date of Patent: Dec. 30, 2003

(54) SYSTEM OF HIT DETECTION AND SIGNALING FOR FENCING

(75) Inventor: Frédéric Marciano, Besancon (FR)

(73) Assignee: Computer Masters International, Besancon (FR)

( * ) Notice: Subject to any disclaimer, the term of this patent is extended or adjusted under 35 U.S.C. 154(b) by 95 days.

(21) Appl. No.: 09/810,543

(22) Filed: Mar. 19, 2001

(65) Prior Publication Data

US 2001/0023218 A1 Sep. 20, 2001

(30) Foreign Application Priority Data

Mar. 17, 2000 (FR) ..... 00 03476

(51) Int. Cl.[7] ..... A63B 69/02
(52) U.S. Cl. ..... 482/12; 482/83; 482/84
(58) Field of Search ..... 482/1–8, 12, 83, 482/84, 90; 463/1, 4, 5, 7, 8

(56) References Cited

U.S. PATENT DOCUMENTS 3,920,242 A 11/1975 Reith et al.
4,824,107 A * 4/1989 French ..... 273/454
5,184,831 A * 2/1993 Garner ..... 482/84
5,836,853 A * 11/1998 Marciano ..... 482/12

FOREIGN PATENT DOCUMENTS

| | | |
|---|---|---|
| DE | 298 12961 | 12/1989 |
| FR | 1 132 671 | 3/1957 |
| FR | 1 162 554 | 9/1958 |

* cited by examiner

*Primary Examiner*—Glenn E. Richman
(74) *Attorney, Agent, or Firm*—Young & Thompson

(57) ABSTRACT

A system of hit detection and signaling for fencing, in particular for the epee, includes, for each adversary, an outfit completely conductive surface wise, a fencing conductive mask endowed with a luminous hit signaling device and a weapon, in particular an epee, a guard made of an isolating material or covered with an isolating material and whose tip at least is conductive, the outfit and the mask, and the tip of the weapon for each adversary being connected, separately, to a hit detection unit, appearing as a central detection and signaling unit to which they are wired or as a portable unit carried by each adversary also connected to the luminous signaling device and to the conductive soles of shoes worn by the appropriate adversary.

13 Claims, 5 Drawing Sheets

17′
16′
18′

12′
12″
1
10
10
9
9
9′
9′

Fig. 5
Fig. 5A
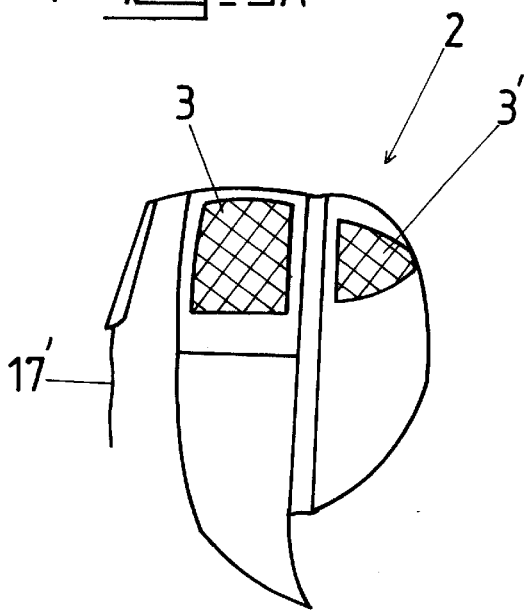
Fig. 5B
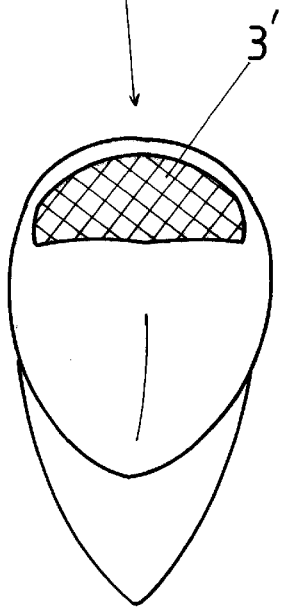
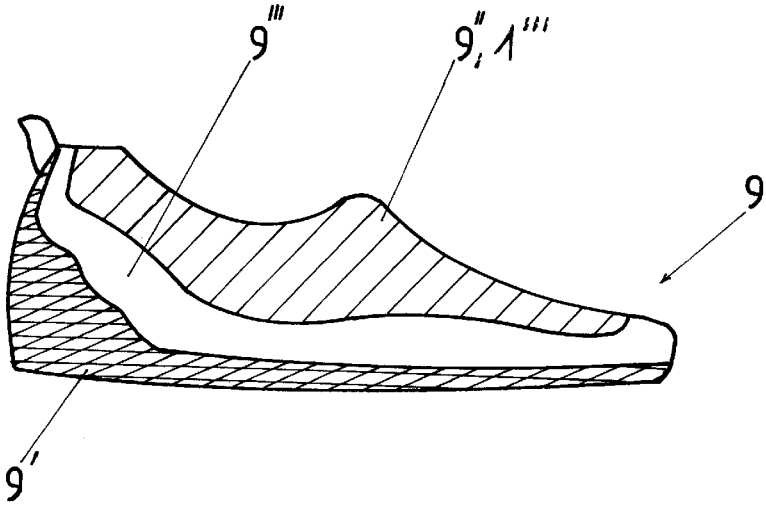
Fig. 6

SYSTEM OF HIT DETECTION AND SIGNALING FOR FENCING

BACKGROUND OF THE INVENTION

The following invention concerns combat sports with blades, in particular the sport of fencing, and leads to a system for hit detection and signaling in fencing.

DESCRIPTION OF THE RELATED ART

Currently, a hit detection system for the epee used in international fencing tournaments must be designed to meet the following specifications:

- detection of a hit by simple closing of the tip with timing constraints
- cancellation of a hit to ground
- cancellation of a hit on the opponent's guard
- hit discrimination: two successive hit are declared "simultaneous" if they are detected within less than a 50 ms delay.

All of these requirements are satisfied perfectly in current systems where the fencers and the strip are wired permanently to the central detection and signaling device.

The major drawback of these current systems lies with the necessary use of a metallic strip.

The strips assembled with metal plates used in all of the major tournaments are very expensive, heavy and require tedious installation work. They are too expensive for most fencing clubs.

Such a system is represented in FIG. 1 of the appended drawings (the hatched zones represent the conductive surfaces).

Furthermore, several wireless hit detection and signaling systems for fencing have been implemented lately. These systems are based in part or in totality on the technical concepts described in documents FR-A-2 280 407 and FRA-A-2 739 787.

The devices developed in accordance with these documents present the drawbacks discussed hereafter, in particular for the epee which happens to be the main weapon in fencing both in terms of number of registered fencers and overall importance.

The known systems derived from document FR-A-2 280 407 use capacitive coupling of the human body to ground. Each fencer is equipped with a portable radiofrequency transmitter/receiver system and the two systems are weakly coupled to one another, because each portable is connected directly to the body of the fencer, himself coupled to ground. Hence, these portables are able to communicate with eachother after the appropriate amplification of the generated signals.

However, the drawbacks of these devices are numerous:

- Capacitive coupling through the human body is very unstable and difficult to quantify. It changes with the fencer and with sweat. What's more, with jumping, the amount of coupling decreases tremendously requiring a different setting for each device.
- Cancellation of a hit is done by introducing a very powerful modulation into the strip. The efficiency of this signal depends on the degree of coupling between the strip and ground. If the strip is connected directly to ground, the signal doesn't go through. If the strip is on the floor, enormous power may be required to generate the appropriate signal. In any case, computer simulations and experience show that this hit cancellation is uncertain.
- Hit cancellation on the guard is very perturbed as soon as the body of the fencer is in contact with his own weapon, through a sweaty glove for example.

- The use of radio is necessary to implement hit detection with all the drawbacks that go along with the use of this technology: possibility of perturbations from a distance leading eventually to jamming of the tournament etc . . . . Radio is ill-suited to real time data processing as have shown various examples of implementation that have all been failures.
- Even if all the previous drawbacks were entirely eliminated, the system would still be tied down by a structural drawback: the direct connection of the device to the fencer's skin. As a consequence of this implementation, the system is unable to pass any medical certification.

The device described in document FR-A-2 739 787 (and according to the corresponding document EP-A-0 768 101) was developed to eliminate most of the drawbacks mentioned above with respect to the system described in document FR-A-2 280 407.

In the system described in document FR-A-2 739 787, there is no longer any direct coupling with the body and hence the system ca no longer be jammed since discrimination is obtained through signals transmitted in the strip.

It does entail however the following drawbacks:

- Necessary use of a floating strip obtained by isolation or placement on a raised podium,
- Possible delay between the time when the fencer registers a hit and when he falls back to ground in the case of a hit occuring when the fencer is above the strip.

SUMMARY OF THE INVENTION

The goal of the invention that follows is the elimination, if not all, of most of the drawbacks addressed previously and to put forward a system that can easily lead to a wired system that gets rid of the strip or a wireless implementation with a very reliable hit detection.

Hence, the goal of the current invention is the implementation of a hit detection and signaling system for fencing, in particular for the epee, that is composed for each fencer first of a entirely conductive outfit followed by a conductive mask eventually endowed with an integrated luminous signaling device and finally a weapon, in particular an epee, comprising a guard made of a non conductive material or covered by an insulating material and whose tip is conductive, the outfit and the mask on one hand and at least the tip of the weapon on the other for each fencer are connected separately to a hit detection unit either in the form of a central detection and signaling unit through wires or a portable unit on each fencer connected to the luminous signaling unit in the mask and to conductive soles of the shoes worn by the given fencer.

BRIEF DESCRIPTION OF THE DRAWINGS

The invention will be better understood with the description that follows relating to preferred modes of implementation, given as non limiting examples and explained with reference to the appended drawings in which:

FIGS. 5A & 5B are representation in lateral and frontal elevation of a mask that belongs to the system according to the invention;

FIG. 6 is a representation in lateral elevation of a shoe with a conductive sole belonging to a wireless version of the system according to the invention;

FIG. 7 is a synoptic representation of a portable module as represented in FIGS. 3 & 4 and, FIG. 8 is a synoptic representation of a central signaling unit in a wireless implementation as represented in FIG. 3.

DESCRIPTION OF THE PREFERRED EMBODIMENT

Figure 1:
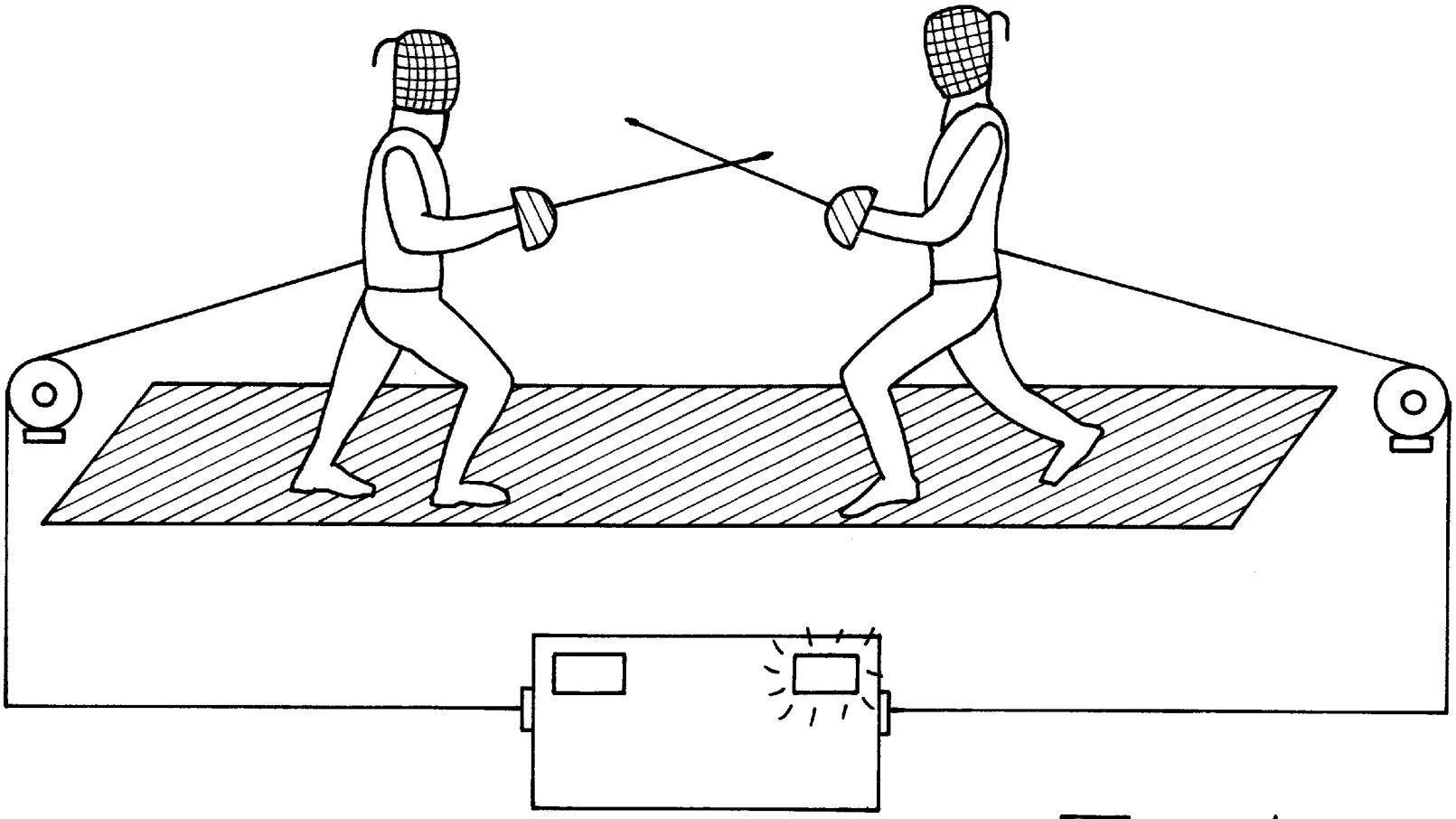
Figure 2:
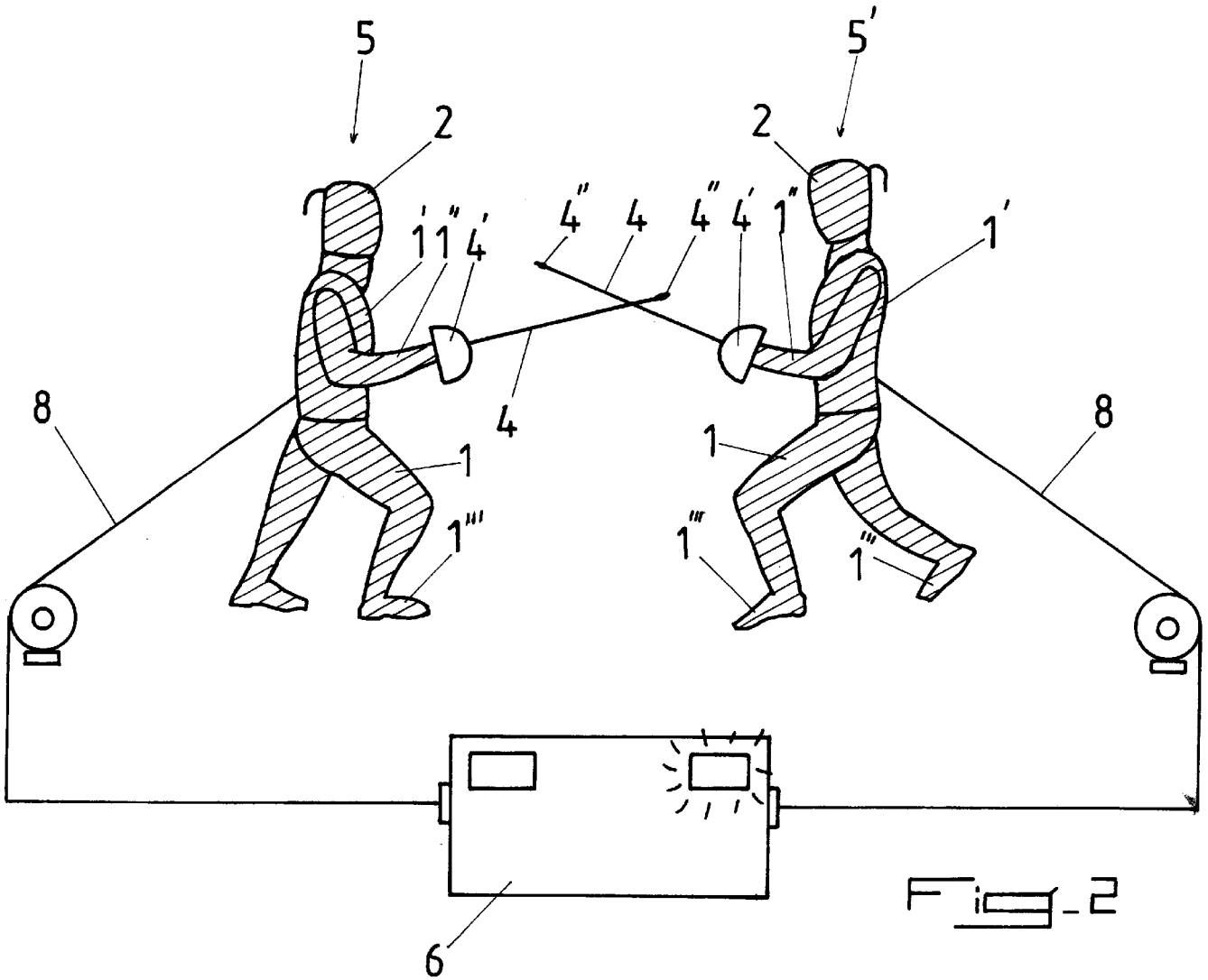
FIG. 2 is a schematic representation of a system according to the invention in an wired implementation.
Figure 3:
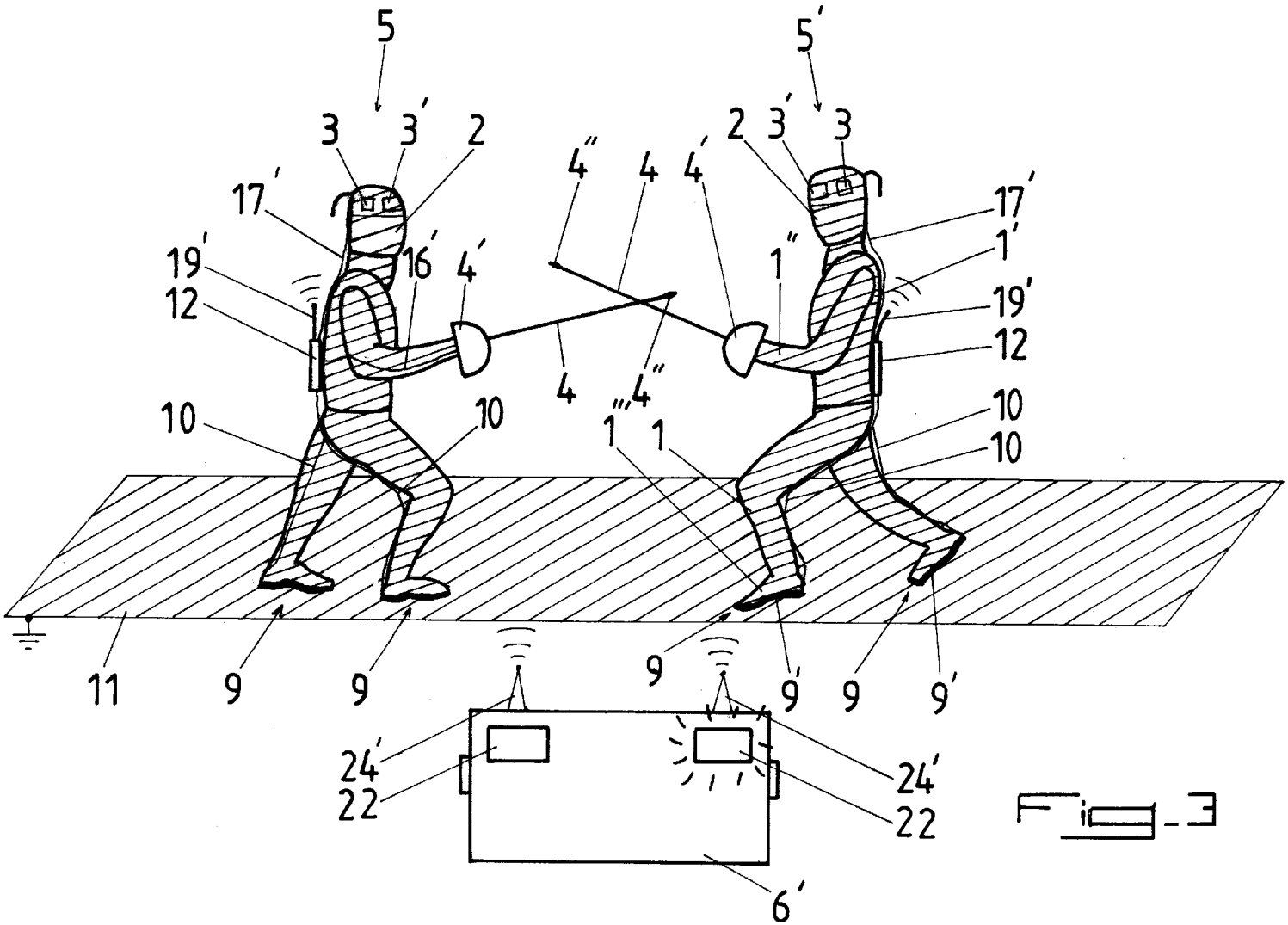
FIG. 3 is a schematic representation of a system designed according to the invention in a wireless implementation.

As FIGS. 2 and 3 of the appended drawings show, the system for hit signaling and detection is mainly composed, for each adversary 5, 5' on one hand of an outfit 1, 1', 1", 1'" that is entirely conductive, on the other hand of a conductive mask 2, endowed eventually with a luminous hit signaling device 3, 3' and finally of a weapon 4, particularly an epee, comprising a guard 4' built out of an isolating material or covered by an isolating material and whose tip 4' at least is conductive, the outfit 1, 1', 1", 1'" and the mask 2, on one hand, and at least the point 4" of weapon 4, on the other hand, of each fencer 5, 5' being connected separately, to a hit detection unit 6 or 7, in the form of a central hit detection and signaling 6 machine to which they are wired 8 or in the form of a portable unit 7 on each adversary 5, 5' also connected to the luminous signaling device 3, 3' and to conductive soles 9' of shoes 9 worn by the adversary 5, 5'.

The basis for the present invention hence consists in the implementation of a new concept for hit detection that in particular in the case of the epee leads to reverse the logic behind current hit detection.

The practical implementation of this concept in the context of the invention leads to a completely conductive outfit for the fencer. This outfit is either implemented by conductive elements (vest, trousers) that are worn over the current outfit or by an outfit made of a material containing fibers or partially woven with conductive thread or processing the current outfit by impregnation, vaporization or any other deposit of a conductive material.

The conductive mask 2 is borrowed from the current saber as well as the conductive glove.

With the help of this outfit, the problem is no longer cancellation of a hit on the guard 4' or on the floor strip 11 but the detection of a hit on the conductive surface of the fencer.

The use of a conductive floor strip 11 in the wire version of the invention becomes irrelevant which leads to fencing with much reduced costs and facilitates the organization of tournaments. What's more, in the wire version, mask 2 may eventually be void of luminous signaling device 3, 3'.

Although the invention here described is particularly designed for the epee, it is easily understood that it can be readily applied, with minor modifications due to regulations specific to each fencing discipline, or to other sports that use blades, and eventually to martial arts.

Thus, the outfit 1, 1', 1", 1'" may have conductive zones corresponding to the surfaces that are taken into account for hit validation as a function of appropriate weapon 4, the eventually different parts 1, 1', 1", 1'" of the aforementioned outfit, as well as the mask 2, being electrically connected to one another as well as to the corresponding unit 6, 7.

The luminous devices 3, 3' for hit signaling of the mask 2, that are, in the wireless implementation, the deciding indicator for hit validation may be implemented in several electroluminescent parts or in several portions 3, 3' such as pieces of electroluminescent cloth or led matrices applied on the front part and the two lateral parts of the aforementioned mask 2, outside of the field of view of the fencer carrying the mask (FIGS. 5A & 5B).

Figure 4:
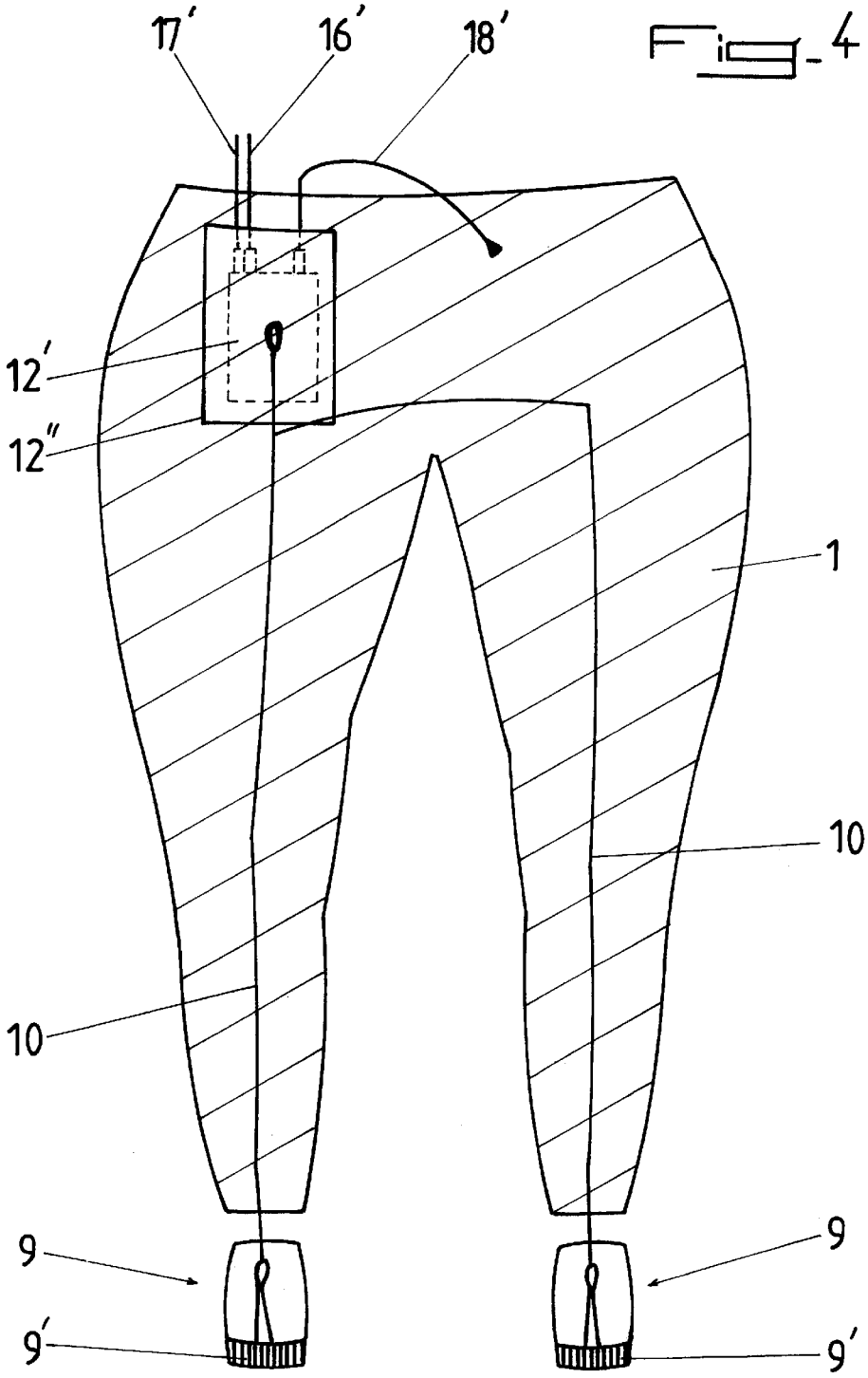
FIG. 4 is a schematic view of a pair of pants and a pair of shoes with conductive soles that are part of the conductive outfit thus conforming to the invention.

In accordance with a characteristic of the invention, represented in FIGS. 3, 4 & 6 of the appended drawings, the conductive soles 9', that are only necessary in the wireless implementation may be connected to the corresponding portable hit detection unit 7 through connection lines based on electrical wires or conductive cloth that has been isolated, integrated to the structure of the pants 1 that is part of the outfit worn by the competitor 5, 5', the shoes 9 comprising the soles 9' mentioned above eventually endowed with a conductive top 9" electrically isolated from the soles 9' with a round about band 9'" made out of a flexible isolating material.

The connection lines 10, for example, may be made out of a band of conductive cloth sandwiched between two isolated and waterproof layers. These composite layers may be removable from the pants 1 (through the use, for example, of a Velcro band—registered trademark) or be electrically connected to soles 9' through pressure buttons (conductive cloth/sole connection).

The soles 9' may, for example, be implemented as described in document FR-A-2 739 787 mentioned above.

In order to provide a ground to make hit detection by the unit 7 reliable, the system will have preferentially in its wireless version a floor strip (i.e., a floor mat) 11 built with a material or with a coating that are conductive for the wireless implementation.

However, the natural grounding of both adversaries 5, 5' (contact to ground) may be enough to assure proper functioning of the invention, especially when only a radio transmission is necessary or wanted, the only condition being that the aforementioned conductive soles 9' may provide a reference for the portable detection units 7.

In accordance with a variation of the implementation of the invention represented in FIGS. 3, 4 and 7 of the appended drawings, each portable detection unit 7 is integrated advantageously in a module 12 comprising, in a box 12' hooked to the outfit, for example in a pocket 12" adapted to the pants 1 of adversary 5, 5', a microprocessor 13, a serial communication bus 14, an accumulator 15, a fencing connector 16 for a cable 16' connecting to the tip 4" of weapon 4, a connector 17 for a cable 17' connecting to the luminous signaling unit 3, 3' of the mask 2, a connector 18 for a cable 18' connecting to the outfit, a certified radio communication circuit 19 transmitting through a transmission/reception antenna 19' or through the conductive soles 9' of a conductive strip 11.

In the wireless application, the system may comprise a central signaling unit 6', located, for example, next to the strip 11, comprising a microprocessor unit 20 connected to a serial bus 21, to signaling lamps 22, to a digital display 23, to an LCD screen 23', to a programmation keyboard and to a radiofrequency transmission/reception circuit 24 designed to communicate with modules 12 carried by the two adversaries 5, 5' associated with either one or both of the adapted antennas 24'.

The operation and the implementation of modules 12 and machines 6 & 6' can be easily derived by the specialist from concepts in the previously cited documents.

However, a noteworthy feature in the wireless application of the current invention must be stressed which is that the portable units 7 implement hit discrimination and blocking of the opposing hit in real time after detecting a hit and once the duration of the fencing time is up.

In the wireless application ot the invention, communication between portable units 7 and the central unit 6' may be established in one of several modes, either purely radio transmission, transmission through the soles 9' in contact with the strip 11 and connected to the portable units 7 through connection lines 10 (by implementing features described in document FR-A-2 739 787) or a mixed transmission combining the two previous modes.

To facilitate even further the understanding of the invention in its wireless version, its operation is quickly described (in relation to FIG. 3).

Hit detection is implemented as in the previously cited document FR-A-2 280 407 by sending a signal through the tip to the opponent's vest.

When the jacket detects the hit, the luminous signal in the mask is turned on, on the side of the fencer who is hit. The weapon of the fencer who is hit is desactivated after the fencing time allowing for a perfect real time implementation of double hits without any recourse to radio communications.

Cancellation of the hit on the guard or the strip is no longer a problem as these surfaces are no longer active (the strip is only used as a reference).

In case of radio jamming, the local luminous device is certified making the system impervious to problems relating to radio transmission.

The system according to the invention will work perfectly well with the conductive strip but can be used for training without the strip by implementing the system described in FR-A-2 280 407 with a major difference however, since there is no longer any direct contact with the skin or body. The reference is the sole of the shoe that is coupled to ground naturally.

The extension of this system to other weapons is natural since the saber already has the metallic vest and this should be the case with the foil in the future with the announced suppression of the non valid hit.

Of course, the invention is not limited to modes of implementation described earlier and represented in the appended drawings. Modifications are still possible, in particular from the viewpoint of the implementation of the different elements or through substitution of technical equivalents without going beyond the scope of the protection of the invention.

What is claimed is:

1. A hit detection and signaling system for fencing, comprising:

for each adversary, a weapon comprising an insulated guard and conductive tip, an outfit with a completely conductive surface and comprising conductive surface areas corresponding to plural hit validation regions for accounting for weapon hits, a conductive fencing mask with a luminous hit signal device, and shoes having conductive soles, and a hit detection unit with a central signaling unit, the central signaling unit being located apart from each adversary, wherein, the outfit, the tip of the weapon, the mask, the conductive surface areas, and the luminous hit signal device associated with each adversary are connected, via a separate connection path for each adversary, to the hit detection unit, and the soles of the shoes are not part of the connection path to the central signaling unit.

2. The system of claim 1, wherein the weapon is one or an epee and a sword.

3. The system of claim 1, wherein the insulated is made of an insulating material.

4. The system of claim 1, wherein the insulated guard is covered with an insulating material.

5. The system of claim 1, wherein, the hit detection unit further comprises a central detection unit, the connection path to the hit detection unit from each adversary is a connection wire, and the soles of the shoes are capacitatively coupled to ground.

6. The system of claim 1, wherein, the hit detection unit comprises a portable hit detection unit worn by each adversary, and each portable hit detection unit is linked through a radio frequency link to the central signaling unit.

7. System according to claim 1, wherein the luminous hit signaling devices (3, 3') of the mask (2) comprise plural spacially separated electroluminescent elements.

8. The system of claim 7, wherein the electroluminescent elements are formed of electroluminescent cloth or diode matrices placed on a front and two lateral faces of the mask, outside a normal field of view of a person wearing the mask.

9. System according to claim 7, wherein each outfit further comprises a pants portion, the conductive soles (9') are connected to the corresponding portable hit detection unit (7) by connection lines (10) via the pants portion, the shoes (9) comprise conductive tops electrically isolated from the soles by an isolating material.

10. System according to claim 1, further comprising a conductive floor strip (11) for a wireless implementation of the system.

11. System according to claim 7, wherein each portable hit detection unit (7) is integrated into a module (12) comprising, in a box (12') placed on the outfit, a microprocessor (13), a serial communications bus (14), an accumulator (15), a connector (16) for a cable (16') connecting to the tip (4") of the weapon (4), a connector (17) for a cable (17') connecting to the signal device of the mask (2), a connector (18) for a cable (18') connecting to the outfit and a certified radio transmission circuit (19).

12. System according to claim 11, further comprising a central signaling unit including a central microprocessor unit (2) connected through a serial bus (21) to signal lamps (22), a digital display (23), an LCD screen (23'), a programming keyboard, an adapted antenna, and a certified radio transmission circuit tuned to frequencies of portable radio frequency transmission modules (12) carried by the two adversaries (5, 5').

13. System according to claim 6, wherein the portable hit detection units (7) implement a real time hit blocking of the opponent's hit once a hit has been detected.

* * * * *